US005408949A

United States Patent [19]

Deputy

[11] Patent Number: 5,408,949

[45] Date of Patent: Apr. 25, 1995

[54] BOAT SEAT

[76] Inventor: Lawrence P. Deputy, 22664 Weatherby La., Elhart, Ind. 46514

[21] Appl. No.: 998,816

[22] Filed: Dec. 30, 1992

[51] Int. Cl.[6] ..... B63B 17/00

[52] U.S. Cl. ..... 114/363; 114/364

[58] Field of Search ..... 114/363, 364, 343, 347; 297/232, 233; D6/355, 356

[56] References Cited

U.S. PATENT DOCUMENTS

| | | | |
|---|---|---|---|
| 818,986 | 4/1886 | Tubbs | 114/363 |
| 1,595,096 | 7/1926 | Hooker | 114/363 |
| 2,472,185 | 6/1949 | Apez | 114/363 |
| 2,757,630 | 8/1956 | Ottinger | 114/363 |
| 3,179,961 | 4/1965 | Ward | 114/363 |

*Primary Examiner*—Robert J. Oberleitner
*Assistant Examiner*—Clifford T. Bartz
*Attorney, Agent, or Firm*—James D. Hall

[57] ABSTRACT

The present invention involves an ergonomic stern seat for a utility boat. The seat extends rearwardly at an oblique angle from the sides of the boat towards the center to form a generally V-shaped seat. The point of intersection of the V-shaped seat is the part of the seat closest to the stern wall. Upright walls extend from the side walls and support a top wall. In the preferred embodiment, those upstanding walls extend at about a 30° angle from the side walls.

3 Claims, 3 Drawing Sheets

BOAT SEAT

BACKGROUND OF THE INVENTION

1. Field of the Invention

This invention relates to boats, and will have application to an ergonomic seat in a utility boat.

2. Related Art

Utility boats are extremely popular among fishermen and hunters. One of the most popular utility boats is the john boat, a flat-bottomed shallow craft favored for its low cost, light weight and ease in maneuverability. John boats may be propelled by oars or by attached electric or gas motors.

Steering of a typical motor driven john boat is at best an uncomfortable experience for the helmsman. Since the typical outboard is equipped with a tiller handle, the helmsman steers the boat by rotating the tiller along a horizontal axis. A conventional rear seat in a john boat is positioned closely adjacent to the stern and is configured straight across the boat from port to starboard sides. As a result, the helmsman has at best a cramped steering position with the motor tiller protruding past the seat.

SUMMARY OF THE INVENTION

The utility boat of this invention includes a stern seat which is ergonomically configured so as to provide the helmsman a comfortable and more efficient seating position while steering the boat. The seat is angled obliquely from both sides of the boat towards the center to from a generally V-shaped seat which provides the helmsman with comfortable seating.

Accordingly, it is an object of this invention to provide for a novel utility boat.

Another object is to provide for a utility boat which has an ergonomically designed stern seat.

Other objects will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

Figure 1:
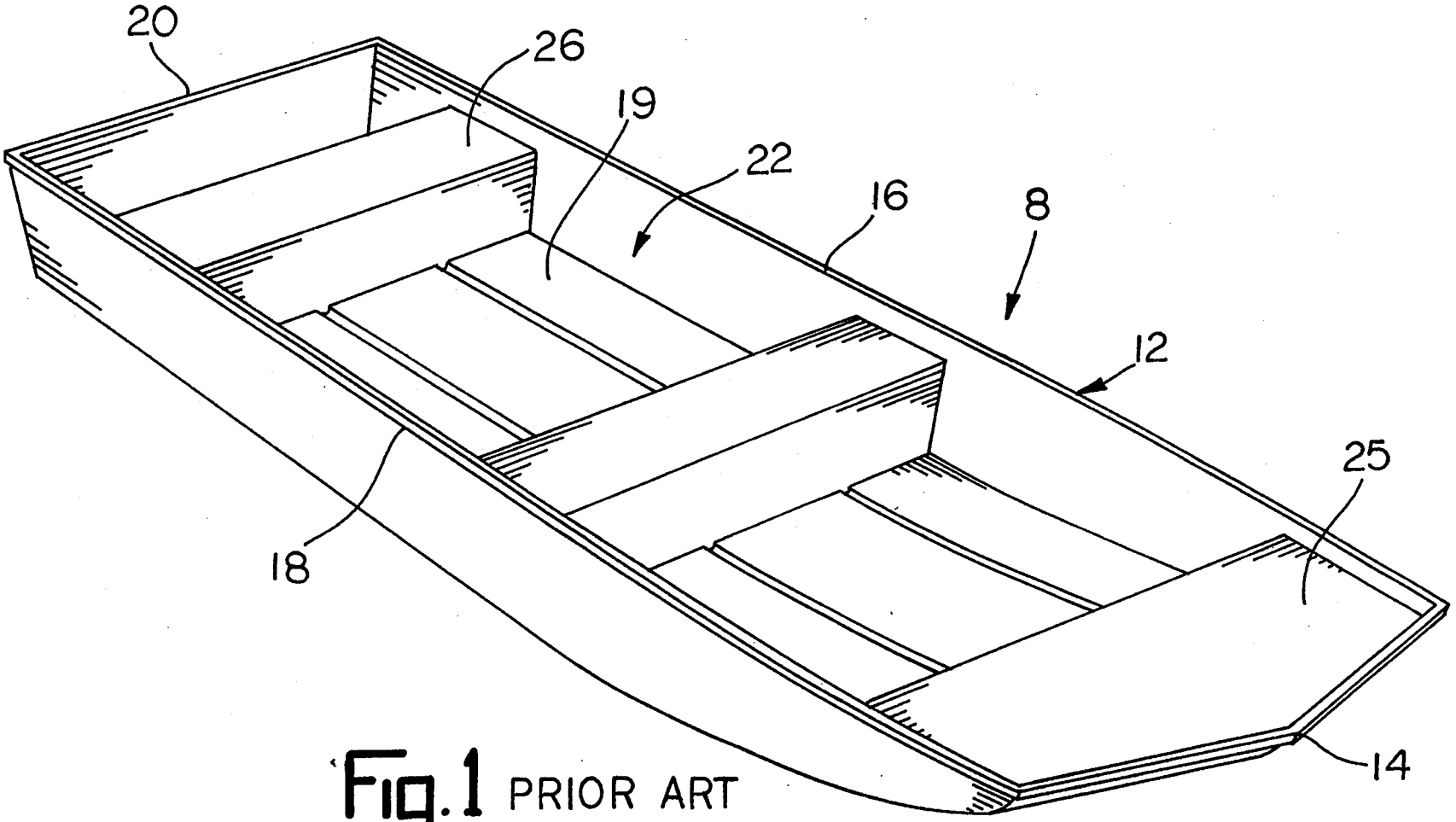
Fig. 1 PRIOR ART
FIG. 1 is a perspective view of the a illustrating a conventional stern seat.

The preferred embodiment herein described is not intended to be exhaustive or to limit the invention to the precise form disclosed. It is chosen and described to explain the principles of the invention and its application and practical use to enable others skilled in the art to following its teachings.

Referring now to the drawings, reference numeral 8 refers generally to a utility boat construction. Boat 8 includes a hull 12 defining a bow or front end 14, port and starboard sides 16, 18, bottom 19, and stern or aft end 20. Hull 12 defines a seating compartment 22 to accommodate one or more passengers. Boat 8 also includes bow seat 25 and stern seat 26, as shown.

Figure 2:
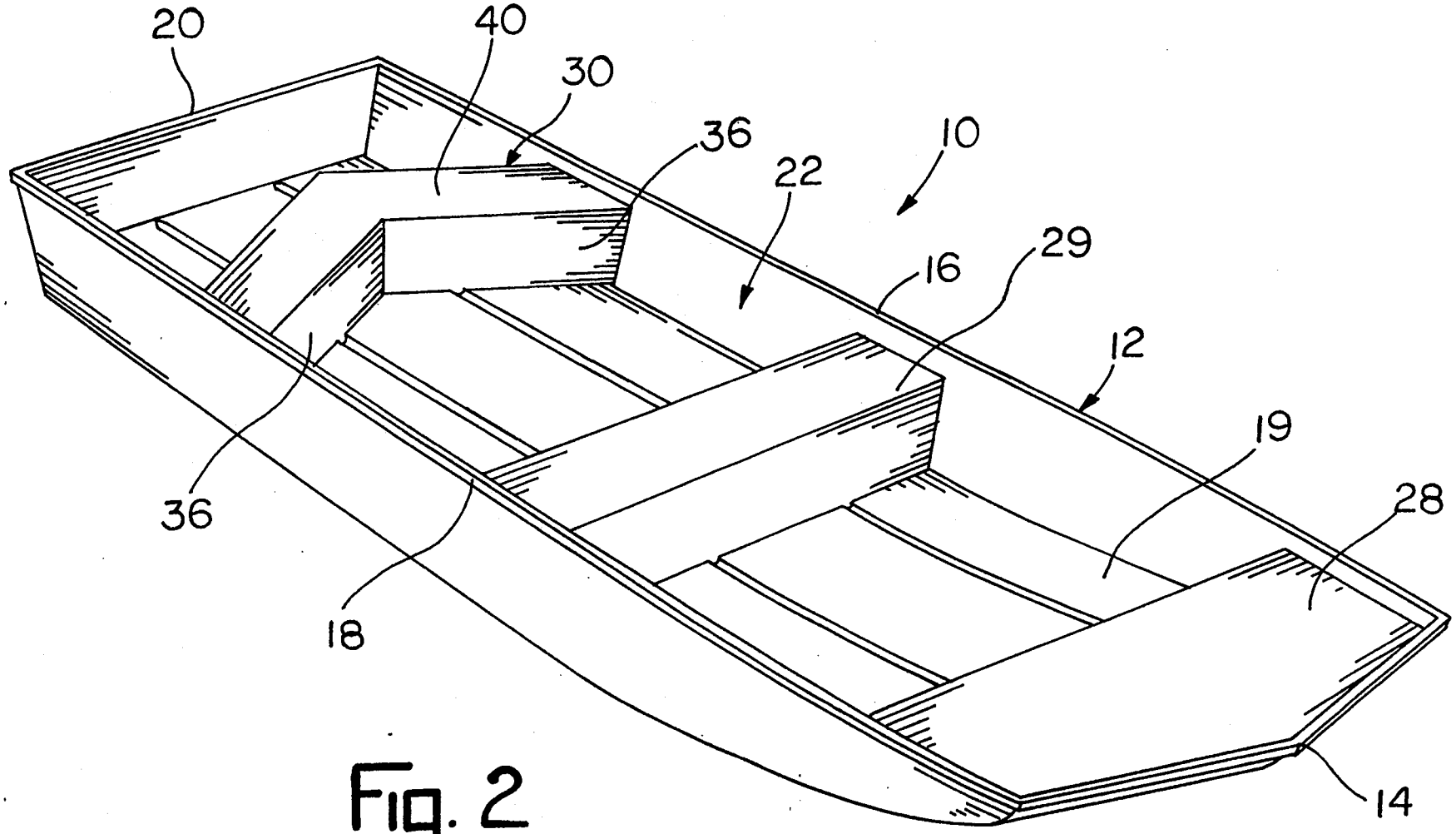
FIG. 2 is a perspective view of the boat of this invention showing the novel stern seat.
Figure 3:
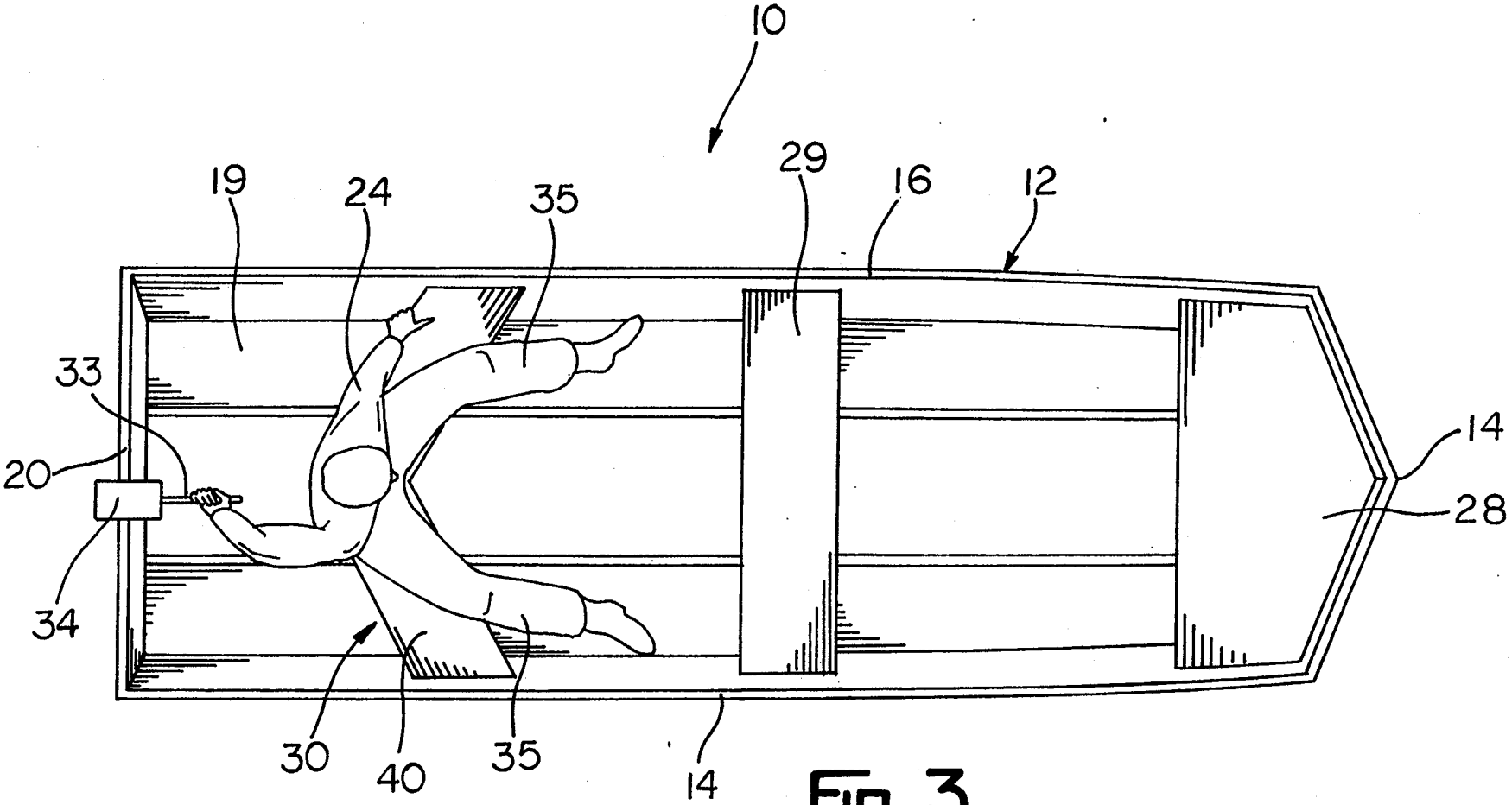
FIG. 3 is a top plan view of the boat in use.

Reference numeral 10 refers generally to the utility boat of this invention, shown in FIGS. 2 and 3. Boat 10 is configured similarly to boat 8 and the same numbers are employed to identify similar structural parts of the boats.

Boat 10 as shown in the drawings is conventionally referred to as a john boat due to the relatively flat bottom 13 of hull 12. John boats are popular in particular with fisherman and hunters who must traverse shallow waters and are commercially available in lengths ranging from eight feet up to about eighteen feet.

Seating compartment 22 normally includes two or more seats to allow passengers to be seated when travelling in boat 10. In the embodiment shown, three seats, bow seat 28, middle seat 29 and stern seat 30 are common. In longer boats three or even four seats may be present with the additional seats located amidship between bow seat 28 and stern seat 30. Other items, such as storage boxes (as shown) may be located in compartment 22.

Boat 10 may be propelled through water by poles or oars (not shown) or by power assist means, such as an electric trolling motor 34 or even a gas powered outboard motor (not shown). Motor 34 is normally fastened to stern wall 20 in a conventional manner as shown.

Stern seat 30 of this invention is configured generally as shown in the drawings. Seat 30 is substantially V-shaped when viewed from above (FIG. 3) and includes forward upstanding wall rearward upstanding wall (not shown) and bench top 40. Walls 36 terminate and are connected to or integrally formed with port side wall 16 and starboard side wall 18. Each wall 36 proceeds from side walls 16, 18 at an oblique angle (shown at about 30° in FIG. 3) towards stern wall 20 and defining an intersection point at the approximate center line of boat 10. Bench top 40 overlies and is supported by walls 36, 38 to form stern seat 30.

FIG. 2 illustrates the advantages of the novel stern seat 30 during boat usage with the assistance of motor 34. As shown, passenger 24 may be seated atop stem seat 30 with his legs 35 in a comfortable position atop bench 40. Seat 30 may also be positioned so as to allow ample space behind the stern seat so that the tiller arm 33 of motor 34 is easily accessible without turning around, which allows the driver/passenger 24 to control boat steerage from the comfortable, ergonomic position shown. In contrast, a conventional john boat (not shown) has a stern seat configured much like the bow seat 28 shown, and allows insufficient room and comfort for the driver/passenger 24 to steer the boat.

It is to be understood that the invention described is not limited to the precise details above given, particularly with regard to the style of boat 10 and the exact configuration of stern seat 30. Rather, the scope of this invention is defined in the following claims.

I claim:

1. In a boat, said boat including a hull defining a seating compartment, a plurality of seats located in said seating compartment, said hull including side walls and a connected stern wall connected to a bottom wall, the improvement comprising a stern seat being sternmost of said plurality of seats and located adjacent said stern wall, said stern seat having a generally V-shaped configuration, said stern seat defining a point of intersection which is the part of said stern seat closest to said stern wall to form a generally V-configured ergonomic seat, said stern seat including first and second upright walls extending obliquely from a port side wall and said bottom wall towards said stern wall, and third and fourth upright walls extending obliquely from a starboard side wall and said bottom wall towards said stern wall, said first and third upright walls and said second and said fourth upright walls in abutment adjacent to a center line of said hull.

2. The boat of claim 1 wherein said stern seat includes a top wall spanning said first, second, third, and fourth walls.

3. The boat of claim 1 wherein said first, second, third and fourth walls extend from said side walls at about a 30° angle.

* * * * *